United States Patent [19]

Giguere

[11] 4,365,546

[45] Dec. 28, 1982

[54] APPARATUS FOR DEGERMINATING A KERNEL BY COMPRESSING THE EDGES OF THE KERNEL

[75] Inventor: R. James Giguere, Kansas City, Mo.

[73] Assignee: Cereal Enterprisess, Inc., Kansas City, Mo.

[21] Appl. No.: 314,106

[22] Filed: Oct. 23, 1981

Related U.S. Application Data

[60] Division of Ser. No. 93,611, Nov. 13, 1979, Pat. No. 4,301,183, which is a continuation-in-part of Ser. No. 909,974, May 26, 1978, Pat. No. 4,189,503.

[51] Int. Cl.[3] ..... B02C 9/02; B02C 9/04

[52] U.S. Cl. ..... 99/567

[58] Field of Search ..... 426/481, 482, 483, 507; 99/602, 613, 617, 618, 621, 622, 624, 625, 628, 567; 240/7; 260/112 G

[56] References Cited

U.S. PATENT DOCUMENTS

| | | | |
|---|---|---|---|
| 510,304 | 12/1893 | Steenkiste | 426/483 |
| 1,735,550 | 11/1929 | Stanley | 99/621 |
| 2,108,655 | 2/1938 | Demsey | 99/617 |
| 2,379,677 | 7/1942 | Borsakousky | 426/320 |
| 2,392,365 | 1/1946 | Carter | 241/7 |
| 2,413,472 | 5/1946 | Sullivan | 241/8 |
| 2,459,548 | 1/1949 | Singer et al. | 241/8 |
| 2,464,212 | 3/1949 | Carter | 241/7 |
| 2,616,466 | 11/1952 | Lindner et al. | 99/618 |
| 2,879,004 | 3/1959 | Dudds et al. | 241/7 |
| 2,947,484 | 8/1960 | Szasz | 241/10 |
| 3,054,676 | 9/1962 | Lauhoff et al. | 426/453 |
| 3,399,839 | 9/1968 | Anderson et al. | 241/11 |
| 3,734,752 | 5/1973 | Headley | 426/483 |
| 3,979,375 | 9/1976 | Rau et al. | 426/483 |

*Primary Examiner*—Steve Alvo

*Attorney, Agent, or Firm*—Kokjer, Kircher, Bradley, Wharton, Bowman & Johnson

[57] ABSTRACT

A machine for carrying out the degermination of Kernels including rotating discs having corrugation in their facing surfaces in which the kernels are caught and crushed from the thin edges toward the center while avoiding crushing of the relatively flat disc surfaces.

2 Claims, 13 Drawing Figures

CORN
CORN CLEANING
TEMPER
PREFERRED DEGERMINATOR
DEGERMINATOR SIFTER
COARSEST
NEXT COARSEST
FINEST
NEXT FINEST
ASPIRATORS
MOSTLY BRAN
DRY
FEED
DRY/FEED
TABLE #3
TABLE #2
TABLE #1
FEED/OIL RECOVERY
#12 GRITS
#8 GRITS
#4 GRITS
GRADING SIFTER
FLOUR
FEED
FEED
TABLE #4
FEED/OIL RECOVERY
BREWERS GRITS
MEAL

APPARATUS FOR DEGERMINATING A KERNEL BY COMPRESSING THE EDGES OF THE KERNEL

This application is a division of application Ser. No. 93,611 filed Nov. 13, 1979, now U.S. Pat. No. 4,301,183, which is a continuation-in-part of my copending application Ser. No. 909,974, filed May 26, 1978, now U.S. Pat. No. 4,189,503.

BACKGROUND AND SUMMARY OF THE INVENTION

This invention relates to grain milling generally, and more particularly to improved milling processes which accomplish separation of the grain components in a novel manner resulting in substantial economic savings and increased yield. The invention also deals with an improved method and apparatus for degerminating grain such as corn.

Conventional milling techniques utilize a gradual reduction process wherein successive differential grinding and shifting separates the basic components of the whole kernel grain, namely bran, endosperm and germ. The grain is first cleaned with care being taken to maintain the grain intact. With relatively tough grains such as wheat, impact deinfestation may be utilized under proper conditions without the danger of cracking the grain. With most brittle grains such as corn under most conditions, a water wash is normally performed to remove foreign materials while protecting the grain from damage.

Using prior art procedures, the cleaned grain is then subjected to tempering wherein water absorption magnifies the differences in grinding characteristics of the grain components. Finally, the gradual reduction process subjects the grain to multiple grinding and separating steps until the components have been ground to the desired size and purity. The ground product is dried if necessary to meet market specifications, cooled and graded. A typical milling process for highly purified products utilizing conventional techniques has from 50 to 60 separate steps before the end products are reached.

In addition to the expense of the large number of rollers needed in the gradual reduction process, the stock must be elevated each time it is to be passed through another set of rollers, thus requiring expensive conveying equipment. Further, since tempering is necessary to achieve separation of the grain components, the components must be dried to the proper moisture content. Again, this increases the cost and complexity of the milling process and delays its completion. The high fat content and consequent low quality of the "fines" resulting from the conventional process necessitates that they be separated and removed from the stock, which further adds to the difficulty and expense involved.

The degree of separation of germ from endosperm that is achieved with conventional degerminating machines is lacking somewhat in completeness and this causes many of the problems that are encountered in the overall milling process. In the Beall degerminator, which is used extensively in the United States, the grain kernels are rubbed more against one another than against the metal of the machine. As a consequence, even though relatively good separation of the term is achieved, a large quantity of fines is generated and the fines are high in fat content since they contain much germ.

Impact type degerminators are used for specific purposes such as where finished products having high fat content are acceptable (table meal) and where smaller granulation of the finished products is involved (no large grits). The impact degerminators that have been used in the past generate fewer fines than the Beall degerminator and provide higher yields of recovered oil; however, the separation of the germ that is achieved with impact machines is poor and for this reason they have not been widely used. All degerminators that have been proposed or used in the past break the germ, to some degree, and the quality of the product is thus reduced in comparison to products in which the germ is in a whole condition.

It is a primary object of the present invention to provide a method of milling grain which completes the milling process in a minimum number of steps and is therefore more economical than processes employing gradual differential grinding techniques.

As a corollary to the above object, a further objective of the invention is to provide a method of milling grain wherein the fines resulting from the degermination need not be removed in an extra separate step as is required in conventional processes. The fines from the degerminator are normally left in the stock and removed after milling together with the later germinated fines, thus eliminating the necessity for removing the degerminator fines as an added step.

It is also an important aim of this invention to provide a milling process for grain which allows the use of impact deinfestation machines on relatively brittle grain such as corn thereby eliminating the need for a water wash or gravity table cleaning and providing for substantial economic savings in the equipment utilized in carrying out the cleaning operation.

A further aim of the invention is to provide a milling process for corn which accomplishes more effective separation of the black germ tip from the endosperm as a result of reduced grinding of the whole kernel grain and thereby results in a reduced quantity of "black specks" in the end product making it of higher grade and making it more desirable for cereal grits and meal.

Yet another object of the invention is to provide a milling process for corn wherein the need for tempering the grain is eliminated in some situations and cut down in other situations. Accordingly, the expense and delay associated with drying the grain is avoided or reduced appreciably.

In conjunction with the preceding object, it is still another object of the invention to provide a milling process in which only a portion of the grain is tempered, such as the bran, so that only a portion of the grain needs to be dried.

An additional object of the invention is to provide an improved method and apparatus for degerminating grain wherein a high degree of separation of the germ is achieved without the germ being broken.

A still further object of the invention is to provide a method and appartus for degerminating grain wherein the grain kernels are crushed from the thin edges toward the center in a manner to pop the germ component out of the kernel in a substantially whole condition.

Yet another object of the invention is to provide a degerminating apparatus of the character described which assures that crushing forces are applied only to the thin edges and not to the relatively large side surfaces.

It is also an important object of the invention to provide a degerminating apparatus wherein the impact surfaces against which the grain is impelled are adjustable thus assuring the optimum angle of attack regardless of the type of grain or the condition of it.

There are numerous other advantages and objects of the present invention which will be discussed or become apparent from a reading of the following specification and claims:

DETAILED DESCRIPTION OF THE INVENTION

In the accompanying drawings which form a part of the specification and are to be read in conjunction therewith and in which like reference numerals are used to indicate like parts of the various views.

Figure 5:
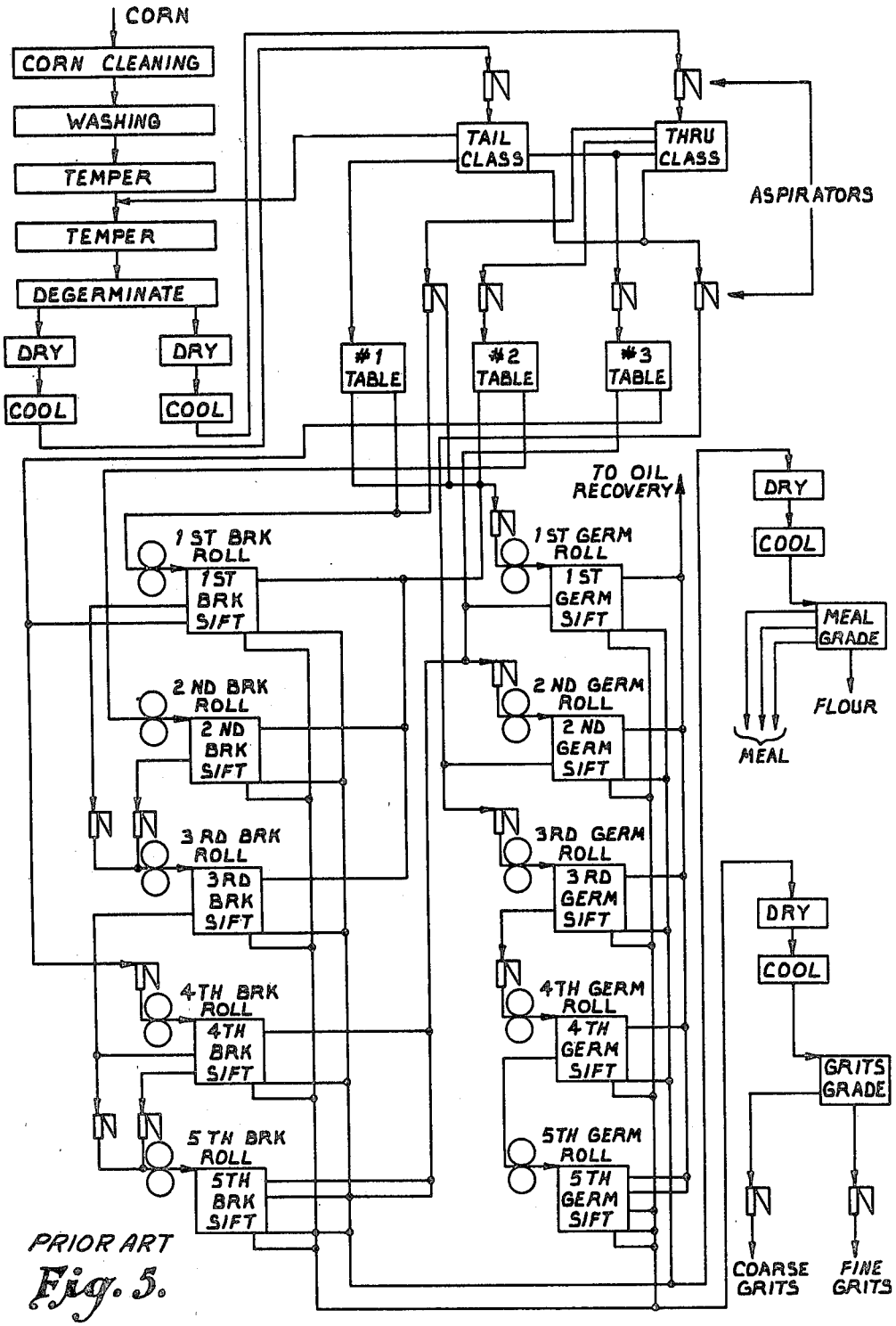
PRIOR ART Fig. 5.
FIG. 5 is a diagrammatic flow sheet of a conventional milling process of the type commonly employed in the prior art.

Referring initially to FIG. 5 which depicts the conventional milling process described briefly above, it is to be emphasized that the illustration of FIG. 5 forms no part of the present invention and is included herein merely for purposes of comparison to allow for a more complete understanding of the present invention. In the interest of brevity, the process shown in FIG. 5 will not be described in intricate detail as a complete understanding will be readily apparent to anyone skilled in the art. Briefly, however, referring to FIG. 5, it is seen that corn is first introduced to a cleaning station wherein foreign materials such as stones, sticks, sand and foreign seeds are removed. The grain is then subjected to a water wash for removal of dirt and other foreign materials. Next, a tempering step is utilized to condition the grain for the subsequent grinding operations. The tempering procedure allows the whole kernel grain to absorb moisture and thereby magnifies the different grinding characteristics of the grain components. Since moisture is absorbed primarily through the germ tip of the grain, the tempering procedure normally lasts for about one and up to several hours depending upon the end product desired and the age and moisture content of the grain being processed. Tempering is achieved in a single or several steps over given time periods using simple water absorption or a combination of water and heat as hot water or steam.

The tempering process results in a relatively highly absorptive germ and bran becoming tough and pliable as these components take on water. On the other hand, the endosperm, which absorbs moisture much more slowly, will remain relatively unchanged although somewhat less brittle. This procedure also helps to commence parting of the endosperm from the germ and bran components.

The next step in the convention process is to pass the tempered grain to a degerminator which breaks the whole kernel grain in a manner to achieve initial separation of germ, bran and endosperm. By far the most widely used type of degerminator is the Beall degerminator which is well known to those in the trade and which generally requires tempering of the grain to a moisture level of from 19% to 25%, depending on the degree of degermination and debranning sought. Also used at times is an impact type degerminator which generates less fines although the degree of germ separation is reduced in comparison to the Beall machine. In any case, the design of the degerminator is such that the germ is intended to be broken out from the endosperm to the extent possible without excessively grinding the germ component. Consideration is given to bran removal in this step depending on the final use of the end product. The goal of the degerminator, namely to remove the germ without grinding it unduly, is not achieved to the desired extent with existing degerminators, and an additional problem is that low quality fines are produced which must be removed prior to further processing of the stock.

Generally the product out of the degerminator is separated into "tail" and "thru" streams, the former being relatively rich in endosperm and the latter being relatively rich in germ and bran. The two streams are then dired and cooled to reduce the moisture content to approximately 17%. Prior to commencing the grinding steps, the two degerminator streams are preferably placed on gravity tables (or aspirators) as indicated in the flow diagram to achieve some further initial sorting out of germ and endosperm.

The roll grinders in the conventional milling process are set up in two series as indicated in the drawing. One series is for the endosperm rich streams and the other series is for the germ rich streams. In the drawing, the various sets of roller mills are indicated diagrammatically and given the conventional designation of break ("brk") rollers and germ rollers.

The concept utilized in each series of roller mills in the conventional milling process is to match particle size with individual roller mill characteristics. Thus, relatively large particles from the gravity tables (or aspirators) are directed to the first break and germ rollers respectively, according to particle size classification. These first rollers are characterized by relatively large corrugations with inherent coarse grinding characteristics. The smaller particles from the gravity tables are directed according to the successively finer series of rollers. For example, the stock going to the number one break roll may be that passing through a sieve with $3\frac{1}{2}$ wires per inch and over one with 5 wires per inch. The roller corrugation used for this stock is 6 per inch. Next, stock passing through a 5 wires per inch mesh but passing over one with 8 per inch is passed to a break roll with 8 corrugations per inch of roll circumference. The procedure is continued up to rolls with 20–24 corrugations per inch.

In general, rollers grinding the streams rich in endosperm have a higher roll speed differential than those grinding the germ rich streams, the reason being that the relatively fragile germ requires the gentler treatment afforded by a lower roll speed differential. This is the reason that two series of roller mills are employed.

Because of the different grinding characteristics of the components, as discussed above, the roller mills in each series will proceed to reduce the size of the endosperm relative to the size of the germ and bran. The mill stock that does not meet final product specification (excepting moisture) is continuously reclassified by size, aspirated to remove bran, and then passed to the next roller mill which is set up to receive the stock according to its primary component and particle size. The process is repeated over and over until the desired separating and sorting is accomplished.

The final steps in the conventional milling process are to dry the milled grain to a maximum moisture content of approximately 12% or to marketing and end use specifications, cool it, and aspirate off any remaining bran. The end product is then graded according to size into various component products.

Figure 10:
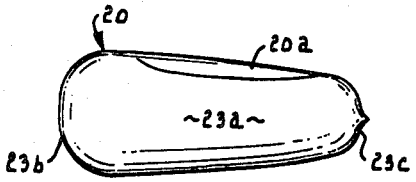
FIG. 10 is a greatly enlarged side elevational view of a kernel of corn.
Figure 11:
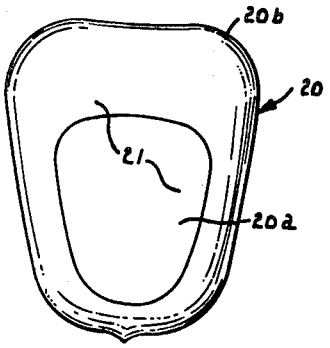
FIG. 11 is a top plan view of the kernel shown in FIG. 10.

With a view to understanding the present invention, reference is first of all made to FIGS. 10 and 11 where it is seen that a corn kernel is designated by the numeral 20 and has a germ portion 20*a* that is surrounded by an endosperm portion 20*b*. FIG. 11 shows in full one of the relatively large flat side surfaces of the kernel which has been designated by the numeral 21. A second large flat side surface (not shown) is opposite and parallel surface 21. The two side surfaces 21 are separated by relatively thin side edges 23*a*, 23*b* and 23*c*. Side edge 23*a* extends the length of the kernel on opposite sides (only one side being visible in FIG. 10). The top side edge is designated 23*b* and the bottom side edge or tip is designated 23*c*. Manifestly, the width of the side edges is equal to the thickness of the grain kernel.

Figure 1:
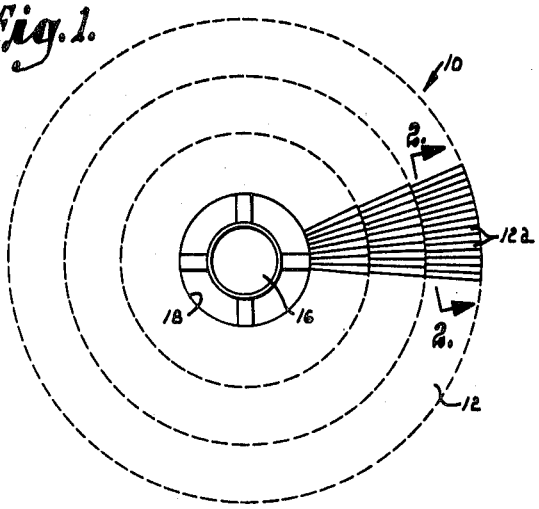
FIG. 1 is a top plan view showing one of the corrugated disc members included in a degerminator machine constructed according to a first embodiment of the present invention, with the broken lines indicating that the corrugations extend along the entire surface of the disc.
Figure 2:
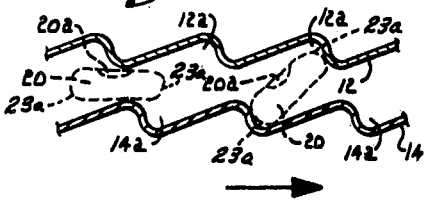
FIG. 2 is a fragmentary sectional view of an enlarged scale taken generally along line 2—2 of FIG. 1 in the direction of the arrows, with corn kernels shown in broken lines.

With reference now to FIGS. 1 and 2, the present invention provides an improved degerminator 10 which is constructed to crush the grain from its thin edges toward the center area of the kernel. The compressive force accompanying this crushing action fractures the endosperm under and around the germ to release it in a manner providing approximately 95% separation from the endosperm while maintaining the germ in a substantially whole condition.

The degerminator machine 10 includes a stationary upper metal disc 12 and a lower disc 14 which is mounted on a vertical shaft 16. The shaft may be driven by any type of drive system (not shown) in order to rotate the lower disc 14 realtive to the stationary upper disc 12. The discs are parallel to one another in horizontal planes, and their facing surfaces are spaced apart in a manner that will be more fully explained.

The stationary upper disc 12 has a central opening 18 through which the grain is introduced to the area between the discs. Each disc 12 and 14 is provided with a plurality of radially extending corrugations 12*a* and 14*a*, respectively. The corrugations 12*a* and 14*a* extend over the entire facing surfaces of the discs. As shown in FIG. 1, the corrugations are greater in number on the outer portion of the discs than on the inner portions to accomodate the larger surface areas of the outer disc portions.

Referring to FIG. 2 particularly, corrugations 12*a* and 14*a* are inclined at approximately a 45° angle (relative to the horizontal) and are sized so that a corn kernel 20 in an inclined orientation can fit with one of its thin side edges 23*a* in the groove of an upper corrugation 12*a* and with the opposite side edge 23*a* of the kernel located in the groove of a lower corrugation 14*a* (see the kernel in the right portion of FIG. 2). However, when the grooves of the corrugations are located directly above one another, they are spaced apart a distance less than the width of kernel 20 between its opposite side edges 23*a*. The respective peaks and valleys of each corrugation are rounded to avoid piercing the kernel at the point of contact. The ridges or peaks of corrugations 12*a* and 14*a* are vertically spaced apart a distance at least as great as the thickness of kernel 20 between its relatively large opposite side surfaces 21. Preferably, the pitch of each corrugation 12*a* and 14*a* is about $\frac{1}{2}$ the width of the kernel (or slightly longer), and the depth of each corrugation is approximately equal to the thickness of the kernel.

In operation, grain is introduced between discs 12 and 14 through opening 18, and shaft 16 is rotated to rotate disc 14 relative to disc 12 in the direction indicated by the directional arrow in FIG. 2. When a kernel positioned between the discs is oriented with its large flat sides 21 facing up and down (as shown for the kernel in the left hand portion of FIG. 2) the kernel passes between the ridges of corrugations 12*a* and 14*a* and no crushing occurs. However, when the kernel is displaced in any fashion from this orientation, the thin opposite side edges 23*a* or 23*b* and 23*c* of the kernel catch in the grooves of opposed corrugations 12*a* and 14*a*. This is the position of the kernel shown in the right hand portion of FIG. 2.

Continued motion of disc 14 relative to disc 12 subjects the kernel caught between the corrugations to a compressive crushing force that is applied from the thin opposite side edges of the kernel toward the center. The magnitude of this crushing force is sufficient to fracture the endosperm under and around the germ 20*a* to thereby squeeze or pop the germ 20*a* out of the side of the kernel in a substantially whole, undamaged condition. The crushing action terminates when the corrugations move past one another. Since the released germ 20*a* is small enough to pass freely between the ridges of the corrugations, it is not crushed and is carried outwardly by centrifugal force along with the fragments of the endosperm resulting from the crushing action. The fines resulting from the degermination contain very little germ since the germ is maintained whole.

The grain may be tempered prior to the degermination, although tempering is not essential. The amount of whole and relatively undamaged germ that is released and the extent to which the germ and endosperm are separated is a function of a number of factors, including the moisture content of the germ, the type and condition of the corn, the configuration of the corrugations 12*a* and 14*a*, or combinations of these and other factors.

Exemplifying the improved results obtained by the degerminating method of this invention, it has been found that midwestern hybrid corn of about 12% moisture and average condition and age yields approximately 85% whole germ and slightly more than 95% separation of germ and endosperm. Tempering the same type of corn to about 17% moisture content for about 3 hours increases the yield to about 95% whole germ and about 97% complete separation of germ and endosperm. The degerminator fines that will pass through a 16 mesh screen vary in quantity from a high of about 20% of the corn degerminated to a low of about 10%, and from a fat content of about 1% to about 5%, depending on the tempering process, the moisture content of the germ and endosperm, the kind of corn, the condition and age of the corn, the relative speed of rotation of discs 12 and 14, the spacing between the discs, the configuration and arrangement of the corrugations, and the condition of the disc surfaces.

Although the degerminator machine 10 is similar in construction to a conventional attrition mill, its operational characteristics differ considerably. The main difference is that the discs 12 and 14 are carefully spaced and the corrugations are arranged to achieve only a crushing effect on the kernel which is applied only from the thin side edges inwardly toward the center, in contrast to the grinding and cutting action of an attrition mill. Since discs 12 and 14 are spaced apart such that a kernel oriented with its flat sides parallel to the planes of the discs passes freely between the ridges of the corrugations, the machine avoids crushing the kernels from the relatively large flat sides thereof, thus assuring that the crushing occurs only at the thin edges in a manner to squeeze the germ free of the endosperm.

Figure 3:
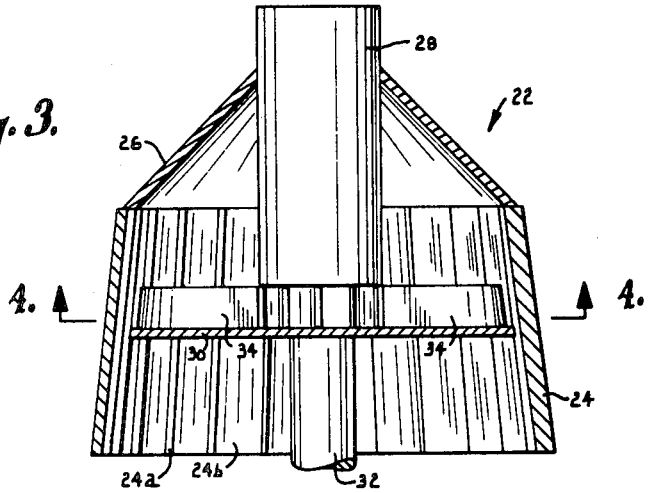
FIG. 3 is a side elevational view, partially in section, showing a degerminator machine constructed according to a second embodiment of the invention.
Figure 4:
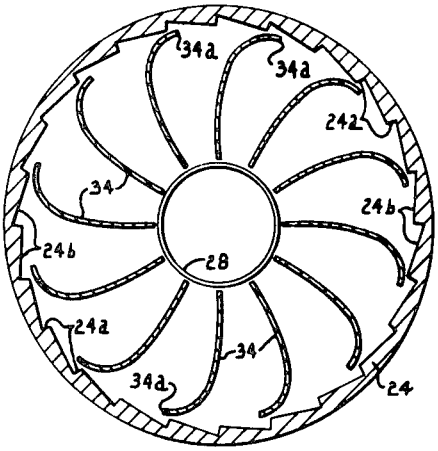
FIG. 4 is a sectional view taken generally along line 4—4 of FIG. 3 in the direction of the arrows.

Referring now to FIGS. 3 and 4, a degerminator constructed in accordance with a second embodiment of the invention is generally designated by numeral 22. Degerminator 22 applies a crushing force similar to that applied by degerminator 10, although in the case of degerminator 22, the force is applied from only one of the thin edges of the kernel toward the center.

The degerminator 22 includes an upright wall 24 having a generally cylindrical shape and surmounted by a frustoconical roof portion 26. A vertical tube 28 extends through roof 26 and is hollow in order to receive and direct grain into the machine. The lower end of tube 28 is open and is located centrally above a horizontal disc 30. Disc 30 is rigidly mounted on top of a vertical shaft 32 which may be rotated by any suitable drive system (not shown).

A plurality of spaced apart guide vanes 34 are located on the upper surface of disc 30. Each vane 34 extends outwardly along the disc from tube 28 to the periphery of the disc. Vanes 34 are curved members each having an end portion 34*a* which extends along the edge of the disc parallel to a tangent to the disc. The vanes 34 are designed so that a kernel which is impelled along the vane by the rotating disc will always have one of its thin side edges leading as it leaves the disc.

The inside surface of wall 24 is located outwardly of the periphery of disc 30 a distance greater than the thicknes of a grain kernel. The inside surface of the wall is formed in a manner to present a plurality of flat linear surfaces 24*a* against which the corn kernels impact when propelled outwardly off of disc 30. Each impact surface 24*a* is oriented such that a kernel propelled off of the periphery of disc 30 and moving in a direction generally tangent to the disc impacts against surface 24*a* with one of its side edges at a right angle. Surfaces 24*b* of wall 24 extend between each adjacent pair of impact surfaces 24*a* to assist in directing the grain kernels against surfaces 24*a* at substantially a right angle. The relative orientation of vanes 34 and impact surfaces 24*a* assures that the crushing force applied to the grain will be applied only from the thin side edges toward the center and not through the relatively flat side surfaces.

In operation, grain is introduced through the tube 28 and onto the upper surface of disc 30. The disc is rotated at a rate of speed high enough to propel the grain outwardly thereon by centrifugal force. As it moves outwardly, the grain is guided along the curved leading surfaces of the guide vanes 34, with one of the thin side edges oriented to form the leading edge until the grain is eventually propelled off of the edge of the disc against the impact surfaces 24*a*.

The crushing force applied on the edge of the kernel toward the center squeezes the germ out from the endosperm in a substantially whole condition. Due to the space between wall 24 and disc 30, any unbroken kernels may pass between the wall and the edge of the disc for recyling without the application of any crushing force to the side surfaces of the kernels.

Figure 12:
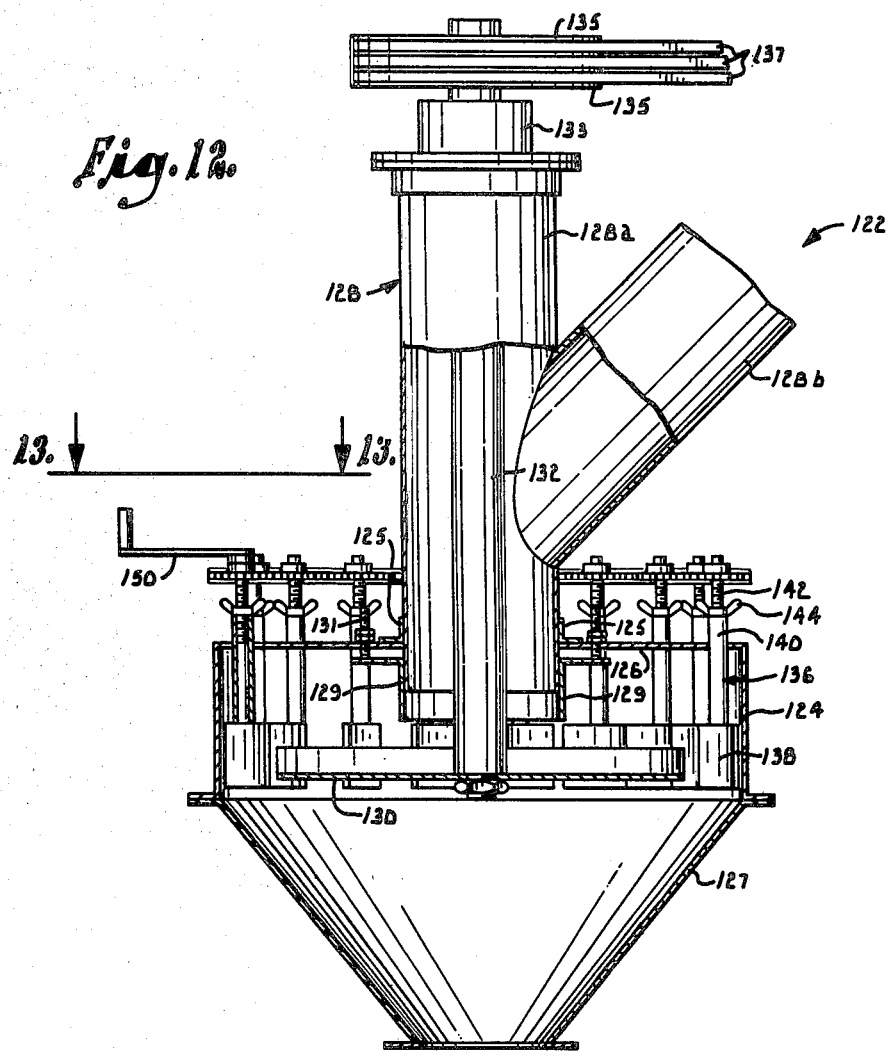
FIG. 12 is a side elevational view with portions broken away and shown in cross section of a modified form of degerminator.
Figure 13:
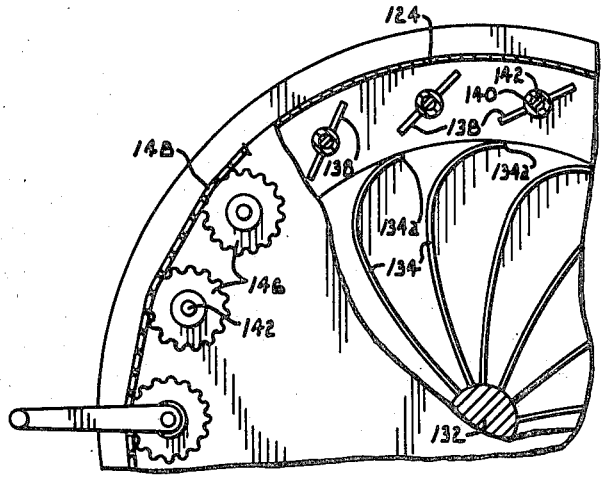
FIG. 13 is a horizontal plan view on an enlarged scale looking in the direction of line 13—13 of FIG. 12.

Referring now to FIGS. 12 and 13, a degerminator constructed in accordance with the third embodiment of the invention is generally designated by the numeral 122. Degerminator 122 is designed to apply a crushing force only to the side edges of a kernel of grain and to avoid any crushing force against the flat sides surfaces the same as degerminators 10 and 22 described above.

Degerminator 122 includes an upright housing 124 having a top 126. The bottom of the housing is formed by a frustoconical topper section 127. A generally Y-shaped housing 128 extends upwardly from housing 124 and is in communication with the latter. Housing 128 is secured to housing 124 by an angle iron bracket 125. An adjustable sleeve 129 is supported by nut and bolt assemblies 131 and is movable relative to housing 128 to vary the rate of flow of material onto disc 130. One leg 128*a* of housing 128 extends substantially vertically and serves to mount a drive shaft 132. The other leg of housing 128 is designated 128*b* and extends at approximately a 45° angle to leg 128*a*. The two legs 128*a* and 128*b* are in communication with one another.

A bearing assembly 133 at the top of housing 128 mounts drive shaft 132 for rotational movement. A drive assembly comprising pulleys 135 and drive belts 137 is utilized to rotate shaft 132. Disposed at the bottom of shaft 132 is a horizontal disc 130 identical in construction to disc 30 of degerminator 22 described above. Thus, disc 130 is also provided with a plurality of radially extending curved vanes 134 each of which terminates in an end portion 134*a* which is disposed parallel to a tangent of the disc.

Disposed around the periphery of housing 124 is a plurality of impact paddles each of which is designated generally by the numeral 136. Each impact paddle 136 includes a generally planar impact surface 138 which extends in a vertical plane transverse to the horizontal plane of disc 130. Each impact surface 138 is spaced from the edge of disc 130 a distance greater than the largest dimension of a whole kernel so as to allow any unbroken kernels to pass between the surface and the disc without damage. Each impact surface 138 is rigid with a support sleeve 140 which extends upwardly through top 126 and threadably receives a mounting screw 142. A wing nut 144 locks sleeve 140 relative to screw 142. Screw 142 is also rigid with a sprocket 146 (FIG. 13). All of the sprockets 146 are designed to move in unison as a result of a common drive chain 148 which circumscribes all of the sprockets. As indicated in FIG. 13, one of the sprockets 146 is provided with a handle 150. Manifestly, movement of handle 150 and its associated sprocket 146 will effect movement of all of the sprockets through drive chain 148.

Operation of degerminator 122 is substantially similar to operation of degerminator 22 described above. The grain is introduced through tube **128*b* onto the upper surface of disc 130. The disc is rotated at a speed high enough to propel the grain outwardly by centrifugal force. As a result of the configuration of vanes 134, the kernels of grain will always be aligned with one of the thin side edges oriented to form the leading edge of the grain as it leaves the disc surface. Similarly, impact surfaces 138 are adjusted for the optimum angle of intersection with the moving grain kernel. The paddles are always adjusted for the type and condition of the grain to assure that the impact forces resulting from the grain kernels striking surfaces 138 will be from the side edges of the kernel toward the center and that there will not be crushing forces applied through the side surfaces of the kernel. Each of the paddles 136 is disposed so that the impact surface 138 is at the same angle relative to the kernels leaving the disc as the other impact surfaces. As indicated above, this angle may be adjusted, however, depending upon the particular type and condition of the grain being degerminated. Generally, surfaces 138 are oriented perpendicular to the line of travel of the grain kernels away from disc 130**.

It is to be understood that various additional types of machines may be employed to carry out the degerminating method of this invention. However, the machines 10, 22 and 122 are preferred since they effectively apply crushing forces to the side edges of the grain while avoiding the application of crushing forces to the relatively large side surfaces.

In addition to the effectiveness of the germ separation, the process of this invention separates the bran from the endosperm with excellent results. As the moisture content of the bran increases, its separation becomes more complete. It has been found that if dry corn of about 14% moisture is tempered for 4 to 8 minutes with addition of water of about 2% to 8% by weight of the corn, 90% to 98% of the bran is removed by the degerminating process as a result of the crushing forces applied to the corn. The degree of debranning is affected by the kind and condition of the corn, the amount of water and heat added and the length of time held, the speed of the discs, and the configuration of corrugations **12*a* and 14*a* or the shape of vanes 34 of 134**. Since on a practical level only the bran is tempered and not the remainder of the corn, drying is simplified because only the bran needs to be sorted out by screens and/or aspiration and sent to dryers. Conventional methods of debranning require tempering of the germ also and/or separate equipment to perform this function. In carrying out the method of the present invention, the power requirements are about 2½ HP per hour per ton of corn, as compared with requirements of conventional processes of from 15 to 25 HP per hour per ton of corn for degerming and debranning.

Another important result obtained by the degerminating process of this invention is the relatively high quality of the degerminator fines which, as previously indicated, have a fat content of about 1% to 5%. In comparison, the fines generated in conventional degerminating processes are so high in fat that they are either sold as a low value byproduct animal feed or are reprocessed to upgrade their quality. Such reprocessing involves the use of sifters, aspirators, gravity tables, purifiers or various combinations of these and other costly devices. Upgrading the quality of the fines with such devices allows the fines to move into industrial uses or other markets where they yield a higher price than animal feed but a lower price than prime products from the mill. In addition, separation of the fines from the prime product is costly and time consuming.

The present invention also provides improved grain milling processes which are illustrated in flow sheet form in FIGS. 6–9. The whole grain or a major part of it may be tempered in some of the processes, although tempering is not always required if the preferred degerminating process described above is used, due to the high degree of degermination and the high quality of the fines. The particular process that may be employed to the best advantage in each set of circumstances depends upon a variety of factors, including the end products desired, the type and condition of the grain, and economic considerations such as operating costs and marketing objectives.

Figure 6:
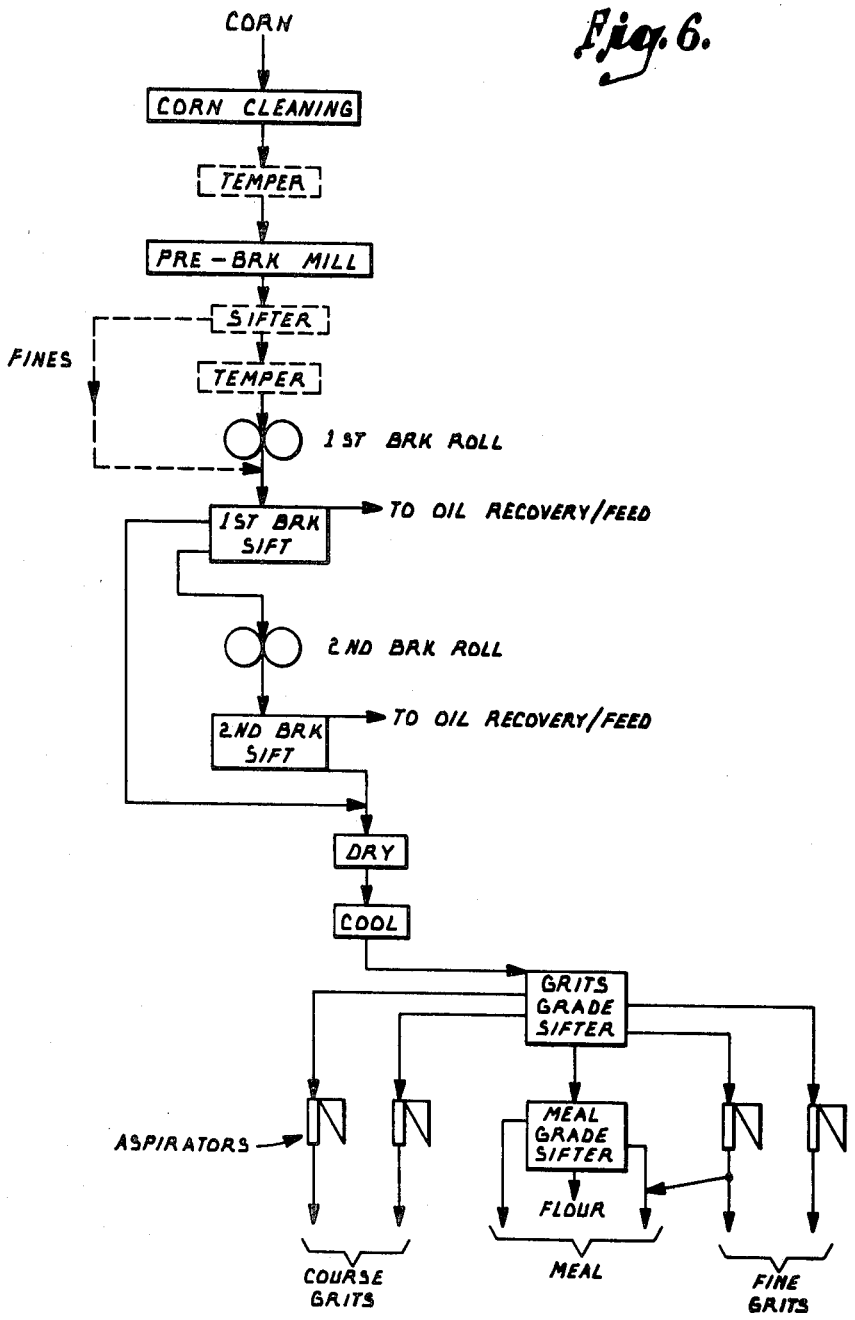
FIG. 6 is a diagrammatic flow sheet of a milling process carried out according to one embodiment of the present invention.

Referring first to FIG. 6, the process shown therein involves cleaning of the corn followed by a prebreaking in a prebreak mill. The prebreak mill may be any suitable type that breaks the grain by subjecting it to a crushing action that breaks the endosperm while preferably although not necessarily maintaining a substantial amount of the germ in a whole condition. The grain should be broken along the germ so the germ is exposed. The crushing action should fracture the grain into at least four and preferably six or more major pieces. The germ should be separated from the endosperm to as great an extent as possible because the fat content of the finished products is reduced as the degree of separation increases. The actual degree of separation of the germ and the extent to which the germ remains whole depend upon the particular prebreaking process utilized and the end product desired.

Tempering of the grain may be carried out in advance of the prebreak or after the prebreak, or both. Tempering before the prebreak better controls the germ separation. For example, corn having a moisture content of 15% to 20% by weight will, when broken, provide better release of the germ with a corresponding reduction in fines and fat content than corn having a moisture content below about 15%. The tempering can be carried out using known techniques.

Tempering after prebreaking may be carried out if the moisture content of the germ and bran was not adjusted by a tempering step prior to prebreak, or if additional moisture content of the germ and bran prior to passage of the stock to the first roller mill should be about 15% to 35% by weight. Tempering after prebreak results in an appreciable shortening of the tempering time because the prebreaking exposes the germ and bran. Tempering can be as short as 2 minutes if heat is used and in no case will it exceed about 30 minutes when performed subsequent to prebreak.

Although a main advantage of the process of this invention is that it avoids the need to remove fines prior to milling, it may be desirable in some instances to remove the fines after prebreak and before milling in order to reduce the water requirements for the tempering step. This can be done in a sifter which sifts the stock after prebreak and before tempering if tempering occurs only after prebreak. The fines are then separated and returned to the stock after it has been tempered and passed through the first set of break rolls if this is desirable to simplify the flow.

The present invention departs from the technique of the conventional grain milling process which, as previously indicated, attempts to match particle size with individual roller mill characteristics. In the conventional gradual reduction process, the particles are first passed through roller mills having relatively large corrugations and then to successive additional roller mills having increasingly finer corrugations. It has heretofore been thought that any atempt to utilize rollers having fine corrugations at the front end of the mill would result in smashing of the grain kernels which would make ultimate separation of germ, bran and endosperm exceedingly difficult.

Instead of passing the grain through a long succession of rollers as is done in the conventional process, grinding is accomplished in the present invention by passing the broken grain directly to fine rollers of the type that normally characterize only the end of a differential milling process.

In accordance with the invention, the prebreaking and tempering steps are effected, and the grain is then passed through a first set of break rolls which may be of the modified Dawson type having 20 corrugations per inch and a spiral of about ½ inch per linear foot. The rollers are arranged dull to dull and have a differential roll speed of 2 to 1. The first break roller mill is adjusted so that at least approximately 50% of the product through is small enough to pass through a U.S. #12 sieve. The spacing between the rollers is sufficient to substantially prevent appreciable penetration of the roller corrugations into the germ, thereby avoiding size reduction of the germ in contrast to the conventional practice of placing fine rollers closer together in accordance with the fine particles being processed. Those particles from the prebreak mill, with the exception of the "fines," are large enough so that they are subjected to a grinding action when passed between the rollers of the first break mill and those of the second break mill.

Due to the fineness of the roller corrugations and their spacing, the endosperm is severely and abruptly ground up and thereby separated from the germ and bran without resulting in the germ being fractured excessively. The product from the first break rolls, together with the fines if they have been removed prior to temper, is sifted through a U.S. #8 sieve and a U.S. #12 sieve. The relatively large size particles over the #8 sieve are primarily germ and bran and may be directed to feed or oil recovery. The portion passing through the #12 screen is less than 1% in fat content, and it is therefore passed to finished product. Particles through the #8 screen but over the #12 screen are principally endosperm, although there is enough germ present that this portion is not marketable as a prime product. This portion is passed to a second set of break rolls which effect further size reduction of the endosperm and which further separate the endosperm from the germ and bran components.

The rollers of the second break mill have corrugations of the same size as the first set or slightly smaller, and the spacing between the rolls is again sufficient to avoid excessive penetration of the germ. The differential speed of the rollers in the second break mill may be reduced to about 1.75 to 1. After passing through the second set of break rolls, the product is sifted through a #14 wire. The particles over the wire are rich in germ and bran and go to animal feed or oil recovery. The stock passing through the wire is rich in endosperm and goes to finished product along with the endosperm rich stock from the first break mill. The endosperm rich stream is dried and cooled if necessary and is finally passed to a grading station where grits and meal are graded according to a size and any remaining bran is removed by aspiration.

The free germ may be removed prior to the first break rolls by utilizing gravity tables. This optional step lowers the fat content of the throughs from the sifter wires, and it aids in making the milling process superior to conventional processes both in quality and product yield.

Although the specific operating parameters for the process depend upon the age of the grain, its moisture content and grade, and the end products desired, it has been found, by way of example, that U.S. grade #2 corn having a moisture content of 13% yields approximately 62% brewer's grits on a U.S. #30 sieve at 1% maximum oil, 8% meal through a U.S. #30 sieve at less than 1.5% oil, 3% flour through a U.S. #80 sieve at about 2% maximum oil, and a brewer's extract on the grits of 80.5% as is basic and prescribed by the American Association of Brewing Chemist Methods. The total prime product yield is 73%. In comparison, a typical yield of equal quality products from the conventional proceed of FIG. 5 is 47% brewer's grits, 9% meal and 5% flour. The total prime product yield is 63% in the conventional process. In addition to providing a higher yield in the more valuable brewer's grits, the process of this invention yields a cereal grit and flour product of higher quality because of a reduction in "black specks." This is attributable to the reduced grinding which leaves most of the germ tip (black speck) attached to the bran or germ, although the extent to which this occurs decreases with a diminishing of the tempering.

Figure 7:
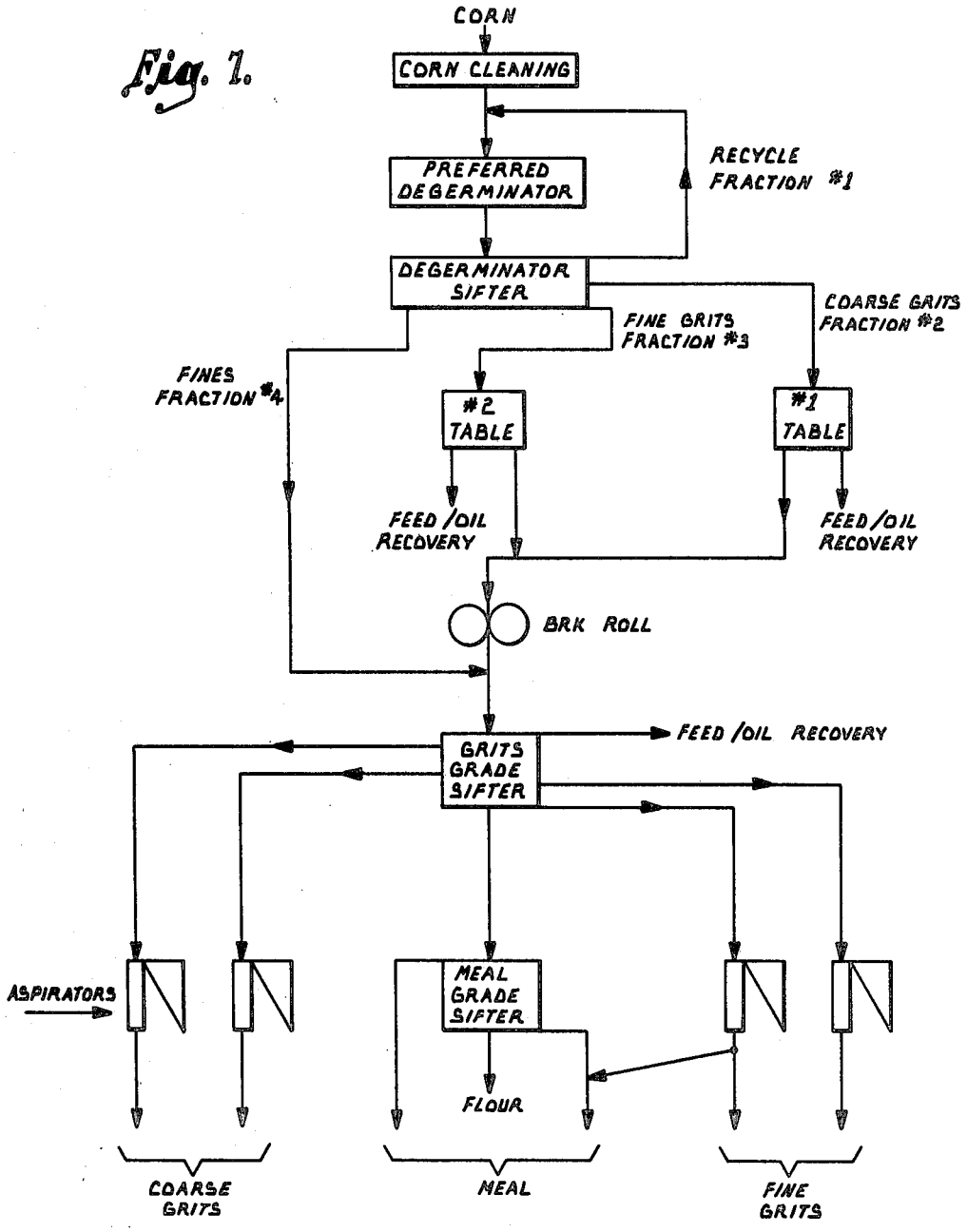
FIG. 7 is a diagrammatic flow sheet of a modified milling process carried out according to the present invention.

FIG. 7 illustrates a modified grain milling process which involves no tempering and has the objective of producing a maximum amount of brewer's grits. After the corn is cleaned, it is degerminated by subjecting it to any one of the degerminators herein described. The grain is thereby crushed from its thin edges toward the center to achieve a high degree of separation of the germ from the endosperm while maintaining the germ in a substantially whole condition.

The degerminator stock is passed to a degerminator sifter which grades it into four streams containing particles of different sizes. A first stream consists of relatively large particles of whole corn or incompletely degerminated pieces of corn. It may not be necessary to separate out this first stream or fraction, depending on the scalp sieve size, the degerminator setting, the condition of the corn, and/or the object of the milling operation. The first stream is recycled or passed again through the degerminator.

The bulk of the degerminator stock is the second coarsest fraction which contains bran, the whole germ and the larger broken germ particles, as well as the pieces of broken endosperm passing over the second sieve. Depending upon a variety of factors, the second sieve can be from 5 to 9 mesh. The second fraction is passed to gravity table #1 where the germ and bran are sorted from the endosperm and directed to feed or oil recovery. If large quantities of corn are being processed so that sheer volume requires the use of a number of gravity tables, more efficient gravity table operation can be obtained by closer sizing of stream #2 into several streams and/or employing aspiration prior to passing the streams to the gravity tables. This will upgrade the finished product in both quality and quantity.

The third fraction includes broken germ, endosperm and bran normally making up between 5% and 25% of the total weight of the corn. This stream goes to gravity table #2 which sorts the germ and bran from the endosperm and directs them to animal feed or an oil recovery system. The endosperm is combined with the endosperm rich stream from gravity table #1 and passed to break rolls having fine corrugations that may be identical with those of the first break roll mill described in connection with the process of FIG. 6. The stock from the break rolls is combined with the fourth and finest fraction from the degerminator sifter.

In a grits grade sifter, most of the germ and bran still remaining in stock are scalped off and directed to feed or oil recovery. The scalp sieve is about 10 to 16 mesh, depending upon the mesh of the sieve for the fourth fraction from the degerminator sifter. The grits grade sifter size classifies the remainder of the roller mill stock which is aspirated conventionally.

It has been found that with U.S. Grade #2 corn having a moisture content of 13%, the process of FIG. 7 yields about 57% brewer's grits over a U.S. #30 sieve with a fat content of 1% or less, about 9% meal through a U.S. #30 sieve and over a U.S. #80 sieve with 1.5% fat or less, and about 5% flour through a #80 sieve at 2.5% maximum fat and a low at less than 1%. The prime product yield is about 71% of the total weight of the cleaned corn, as compared to about 63% for the conventional milling process.

Figure 8:
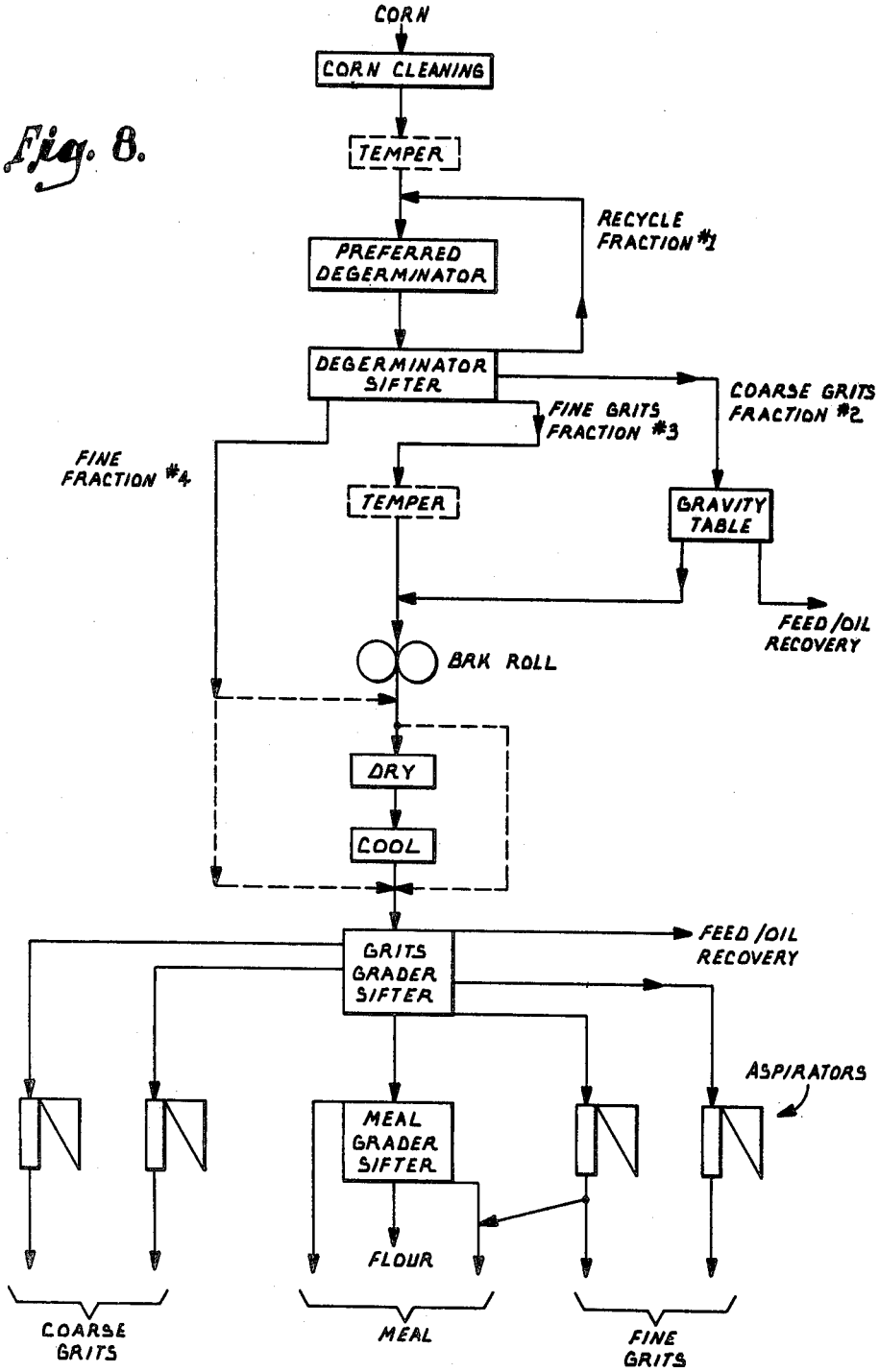
FIG. 8 is a diagrammatic flow sheet of another modified milling process of the present invention.

Referring now to FIG. 8, the milling process shown therein employs tempering and the degerminating by one of the devices described above. The object of the process is to produce a maximum yield of brewer's grits. The process of FIG. 8 is similar to that of FIG. 7, the main difference being that only one gravity table is needed and optional tempering of all or part of the grain may be carried out.

If a particularly high quantity of whole germ is desired from the degerminator or if a small amount of fines and low fat is sought, the grain is tempered after being cleaned and before degermination. Tempering at this point produces high yields and oil quality as compared to the process of FIG. 7. However, the moisture added penetrates deeply into all parts of the corn so that relatively long and extensive drying is required. A small amount of tempering is particularly beneficial if the moisture of the corn is low because in this case the degermination is enhanced appreciably due to the tempering step.

Degermination is effected by any one of the degerminators described above, and the degerminator stock is fed to a degerminator sifter which provides four fractions as in the process of FIG. 7. However, instead of directing fraction #3 to a gravity table, it is tempered, if there was no tempering previously, to bring its germ moisture content in the range of about 15% to 35%.

After tempering of the #3 fraction, it is combined with the endosperm rich grit stream from the gravity table of fraction #2, and the combined streams are then sent to fine break rolls which may be identical with those employed in the process of FIG. 7. The stream from the roller mill may be passed directly to the grits grader sifter or to a drying station and a cooling station if necessary due to marketing or end use objectives. If the grain was tempered before degermination, the fine fraction #4 is combined with the roller mill stock before drying and cooling. The fine fraction #4 from the degerminator sifter can bypass the drying and cooling stations in a situation where only fraction #3 was tempered, since fraction #4 need not be dried in this case. Fraction #4 is then combined with the roller mill stock after drying and cooling. The grits grader sifter and aspiration operations are carried out in the same manner as in the process of FIG. 7.

Minimal tempering yields results similar to and usually somewhat better than are obtained with the process of FIG. 7. More complete tempering gives results better than those of the process of FIG. 6, with yields of prime products running as high as 75% of the cleaned corn.

Figure 9:
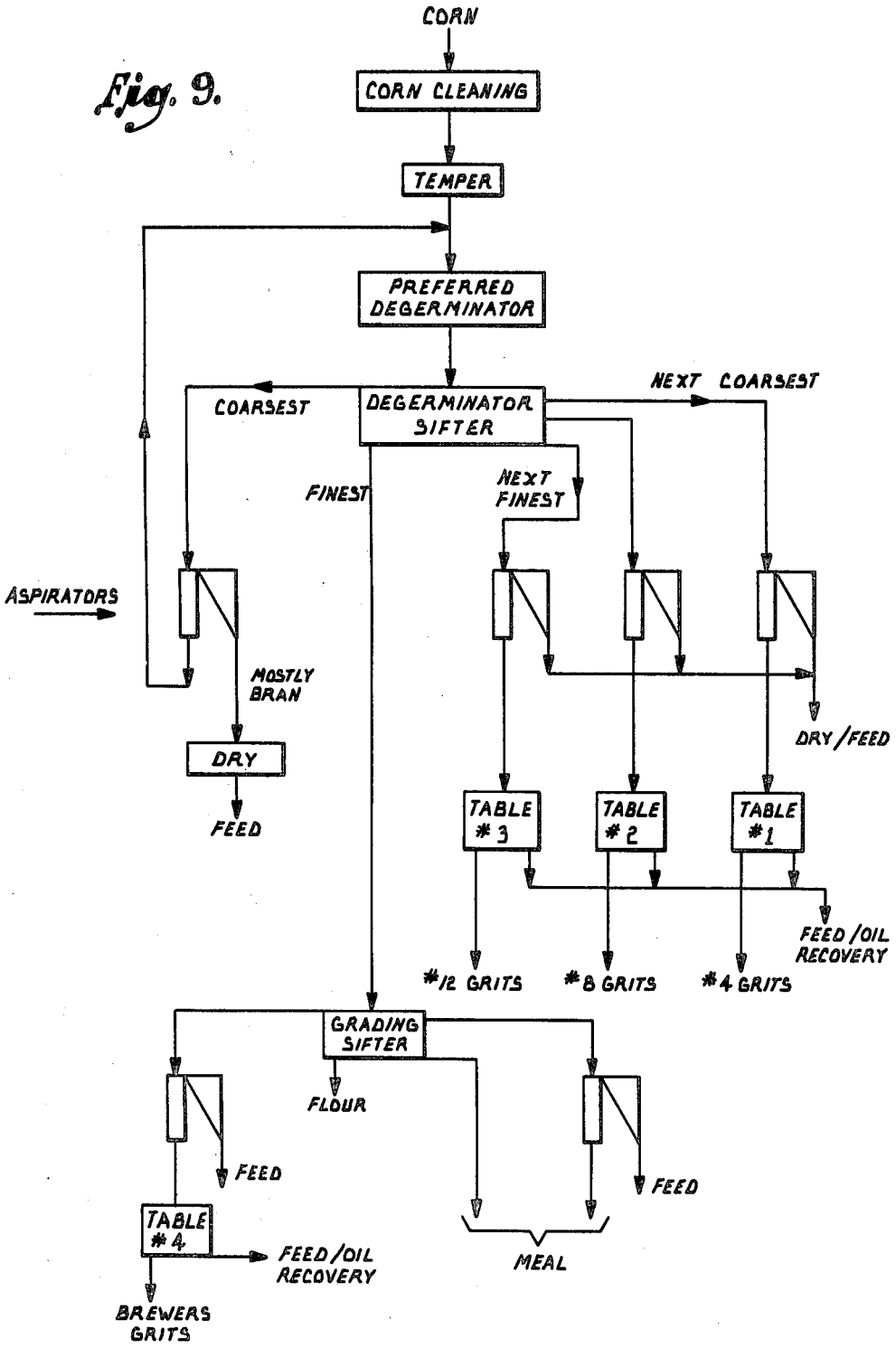
FIG. 9 is a diagrammatic flow sheet of still another modified milling process of the present invention.

FIG. 9 illustrates still another milling process in which the degermination process of the invention is used to debran as well as to degerminate. This process is used primarily to produce extra coarse grits such as those used to make cereal cornflakes in the breakfast food industry. If the objective of the process is to maximize grit size, impact deinfestation is not used to advantage in the corn cleaning operation because the broken corn that results from impact deinfestation is not debranned easily and the yield of larger grits is reduced accordingly.

After the corn is cleaned, it is tempered using water, hot water, and/or steam and is held long enough for the moisture to penetrate and loosen the bran. Unlike the conventional debranning processes which require tempering of the entire kernel, only the bran is tempered and the tempering time is reduced appreciably as a result. After tempering, the grain is degerminated by any one of the degerminators described previously, resulting in the germ being separated from the endosperm and the endosperm being crushed out of the pliable tempered bran.

The degerminator stock is sifted by the degerminator sifter wherein the top or coarsest fraction is scalped off and passed through an aspirator to remove the bran. The bran that is removed may be sent to a dryer if necessary before it is directed to animal feed or to another use. Undegerminated corn or large particles that need to be degermed and/or debranned are recycled from the aspirator back to the degerminator.

The remaining fractions from the degerminator sifter are separated according to size and according to market and/or use objectives and efficient gravity table operation. These fractions are sent to gravity tables which may be preceded by aspirators depending upon the desired efficiency of the gravity tables for separating the grain for drying or other reasons. The aspirating, sifting and gravity table operations are carried out conventionally. It has been found that for particularly efficient bran removal, most of the bran is scalped off in the recycle fraction from the degerminator sifter.

The process of FIG. 9 efficiently and economically produces extra large grits meeting the marketing specifications of fat and bran content. The fraction of extra large grits not used as grits can be reduced in size for brewer's grits and/or meal and added to the products of the degerminating process.

In each of the processes of the present invention, the fines from the degerminator are relatively low in fat content since the germ is maintained in a substantially whole condition. Accordingly, the fines are high enough in quality that they can remain in the prime product stock and need not be separated out and sent to feed as is necessary in the conventional milling process. It is also apparent that fewer steps are required in the milling process of this invention as a result primarily of the high degree of degermination and debranning that is achieved in the degermination process.

The processes illustrated in FIGS. 6–9 can be combined to produce virtually all dry corn milled products with a maximum of flexibility and economy. In addition, in situations where the desired product is cornmeal having a fat level of about 1.2% to 1.5%, even higher yields than those with lower fat products can be achieved by using size reduction equipment to break down the grits.

By virtue of the reduced number of steps required, the process of this invention permits the overall size of the mill to be reduced substantially. Also, the reduction in the amount of equipment provides considerable economy and decreases the maintenance and repair requirements. Since the process stock does not need to be sifted repeatedly as is necessary in the conventional gradual reduction method of milling, only a relatively small amount of sifter cloth is required. Fewer roller mills are needed, and the reduced length of the flow path correspondingly reduces the need for conveying equipment. Further economic benefits result from the reduced power requirements and the decreased need for heating, cooling and drying equipment. The simplicity of the processes has the added benefit of reducing the level of skill and training necessary to operate a mill in which the pocesses are carried out.

While the processes have been described with particular reference to corn milling, they find application also in connection with other grains such as wheat and grain sorghum. Manifestly, with a much smaller sized grain such as milo, rollers having finer corrugations are utilized to achieve the desired separation of components in a minimum number of steps.

The processes of this invention may find application for "clean up" of a stream of broken grain in a conventional milling process. It should also be apparent in connection with the process of FIG. 6 that more than one or two breaks may be made in the prebreak mill and that higher yields or higher quality products may be obtained by using three or more breaks depending upon the results desired and the nature of the grain.

By virture of the economic benefits obtained by using the milling processes of the present invention, dry milling techniques may be extended into areas that have heretofore been thought to be economically impractical. For example, since yields of prime products over 70% are obtained with fat content as low as 0.4%, it is practical to apply the dry milling processes to replace the long, extensive steeping step employed in the wet milling of corn, thereby shortening the process and cutting costs. Another economic advantage of the present invention is the high rate of germ recovery which results in a higher oil yield per bushel of corn than is obtained with conventional dry milling processes.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

I claim:

1. A machine for degerminating a kernel of grain such as corn having relatively large side surfaces and relatively thin side edges, said machine comprising:

first and second relatively movable members presenting opposed crushing surfaces, means mounting said members for relative movement with said crushing surfaces of the members generally parallel to one another;

means providing a plurality of corrugations in said crushing surfaces of said members with smoothly rounded ridges and grooves in facing relationship to the corrugations on the opposite surface, said grooves being spaced apart less than the dimension of the kernel between any two of its opposed side edges to provide said crushing force, said ridges being spaced apart a distance at least as great as the distance between said side surface to avoid the application of any crushing forces to said side surfaces;

a kernel placed between said members and caught between the grooves of opposed corrugations is subjected to compressive crushing forces applied to the edges thereof and toward the center of the kernel which fracture the endosperm portion of the kernel away from the germ portion.

2. A machine as set forth in claim 1 wherein said members comprise first and second relatively rotatable discs.

* * * * *

UNITED STATES PATENT OFFICE
CERTIFICATE OF CORRECTION

PATENT NO. : 4,365,546

DATED : December 28, 1982

INVENTOR(S) : R. James Giguere

It is certified that error appears in the above-identified patent and that said Letters Patent are hereby corrected as shown below:

Claim 1, column 16, line 44, before the words "a kernel", please insert the following: means for rotating the movable members so that Signed and Sealed this

*Fifth* Day of *July 1983*

[SEAL]

*Attest:*

GERALD J. MOSSINGHOFF

*Attesting Officer*

*Commissioner of Patents and Trademarks*